US005604176A

United States Patent [19]

Shimizu et al.

[11] Patent Number: 5,604,176

[45] Date of Patent: Feb. 18, 1997

[54] HEAT-SENSITIVE RECORDING MATERIAL

[75] Inventors: Yoshihiro Shimizu, Nishinomiya; Masato Kawai, Takarazuka; Yasuyoshi Morita, Urawa; Kohei Michikawa, Amagasaki; Takehiro Minami, Osaka, all of Japan

[73] Assignee: New Oji Paper Co., Ltd., Tokyo, Japan

[21] Appl. No.: 429,352

[22] Filed: Apr. 26, 1995

[30] Foreign Application Priority Data

Apr. 27, 1994 [JP] Japan ..... 6-090295
Jun. 30, 1994 [JP] Japan ..... 6-149281

[51] Int. Cl.[6] ..... B41M 5/30

[52] U.S. Cl. ..... 503/207; 427/150; 503/209; 503/214; 503/216

[58] Field of Search ..... 427/150–152; 503/209, 214, 216, 225; 502/207

[56] References Cited

U.S. PATENT DOCUMENTS

| | | | |
|---|---|---|---|
| 4,168,845 | 9/1979 | Oeda et al. | 503/207 |
| 4,226,912 | 10/1980 | Iwasaki et al. | 503/221 |
| 4,322,471 | 3/1982 | Miyakawa | 428/341 |
| 4,948,775 | 8/1990 | Tsuji et al. | 503/207 |
| 5,256,618 | 10/1993 | Takahashi et al. | 503/216 |
| 5,439,869 | 8/1995 | Klug et al. | 503/208 |
| 5,449,657 | 9/1995 | Takahashi | 503/216 |

FOREIGN PATENT DOCUMENTS

| | | | |
|---|---|---|---|
| 37190 | 4/1981 | Japan . | |
| 2148521 | 5/1985 | United Kingdom | 503/209 |

*Primary Examiner*—Bruce H. Hess
*Attorney, Agent, or Firm*—Morgan & Finnegan

[57] ABSTRACT

A heat-sensitive recording material comprises a recording layer containing a colorless or light-colored basic dye and a developing agent on a support. The recording layer further contains a polyethylene having a melting point not lower than 60° C., which is obtained as an emulsion not comprising a surfactant.

The heat-sensitive recording material may be prepared by coating on a support an aqueous coating composition, which contains a colorless or light-colored basic dye and a developing agent together with a polyethylene emulsion comprising a polyethylene having a melting point not lower than 60° C. but no surfactant (e.g. emulsifier), to form a recording layer.

6 Claims, No Drawings

HEAT-SENSITIVE RECORDING MATERIAL

BACKGROUND OF THE INVENTION

The present invention relates to a heat-sensitive recording material utilizing the color reaction between a colorless or light-colored basic dye and a developing agent and relates to a heat-sensitive recording material which is excellent in the retainability of recorded images and water-resistance of recording layer and low in adhesion of smudges.

Heat-sensitive recording materials have been well known in which the color reaction between a colorless or light-colored basic dye and an organic or inorganic developing agent is utilized and both of the colorforming materials are contacted each other to produce a recorded image. Such a heat-sensitive recording material is relatively low in price and the recording equipments used for it is compact and easy in maintainance. Therefore, it has been used in a wide field not only as a recording medium for facsimiles and various computers.

For example, as one of the fields of application, the heat-sensitive recording label for POS (point of sales) system of retail stores and the like can be exemplified. However, as the system has been popularized, their prolonged uses attached on commercial products have increased aside from the food labels which discharge the role in a short period as before. However, in such applications, they contact with water, laps, oils and the like and the recorded images are discolored or the recording layer is peeled off to deteriorate remarkably the product image as the result. Therefore, it is required that a heat-sensitive recording material has the retainabilities such as water resistance, plastisizer resistance, oil resistance and the like.

Also, a heat-resistant recording material is required which can record in a heat-resistant facsimiles at a speed of 10 seconds or lower for A4 size and in a heat-sensitive printer at a speed not lower than 120 letters/second. However, when the recording speed is increased, smudges adhered on the head during recording give no uniform recorded image disadvantageously.

Though a method for adding a paraffin wax to the recording layer for eliminating head smudges had been described in JP A 1-133783, it gave no sufficient water-resistance by the effect of the emulsifiers and the like used for finely dispersing the paraffin wax.

An object of the present invention is to provide a heat-sensitive recording material which is excellent in the retainability of recorded images and water-resistance of recording layer and low in adhesion of head smudges.

SUMMARY OF THE INVENTION

A heat-sensitive recording material according to the present invention comprises a recording layer containing a colorless or light-colored basic dye and a developing agent on a support. The recording layer further contains a polyethylene having a melting point not lower than 60° C., which is obtained as an emulsion not comprising a surfactant.

The heat-sensitive recording material may be prepared by coating on a support an aqueous coating composition, which contains a colorless or light-colored basic dye and a developing agent together with a polyethylene emulsion comprising a polyethylene having a melting point not lower than 60° C. but no surfactant, to form a recording layer.

DETAILED DESCRIPTION OF THE INVENTION

The polyethylene emulsion, which comprised a polyethylene having a melting point no lower than 60° C. but no surfactant, can be prepared by adding to ethylene monomer a small amount of an ethylenically unsaturated carboxylic acid monomer such as acrylic acid, methacrylic acid, itaconic acid, crotonic acid, fumaric acid, maleic anhydride, styrenesulfonic acid and the like, polymerizing it and then neutralizing it with an alkali. The particle size of the polyethylene emulsion is preferably 0.01 to 10 μm and more preferably 0.02 to 3 μm.

The amount of the specific polyethylene emulsion added to the recording layer is preferably 2 to 30 weight % and more preferably 5 to 20 weight % based on the total solid in the recording layer. A melting point of the soap-free polyethylene lower than 60° C. can give no uniform smoothness when the recording layer is formed and then smoothened by a super calender.

If a surfactant (e.g. emulsifier) is contained in the polyethylene emulsion, it gives effects such that background fogging occurs by it and the water-resistance of the recording layer is lowered.

In the present invention, various known colorless or light-colored basic dyes may be contained in the heat-sensitive recording layer. They include, for example, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-diethylamino-7-dibenzylaminobenzo[a]fluoran, 3-(N-ethyl-N-p-tolyl)amino-7-N-methylanilinofluoran, 3-diethylamino-7-anilinofluoran, 3-diethylamino-7-dibenzylaminofluoran, 3,6-bis(diethylamino)fluoran-γ-anilinolactam, 3-cyclohexylamino-6-chlorofluoran, 3-diethylamino-6-methyl-7-chlorofluoran, 3-diethylamino-7-chlorofluoran, 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-diethylamino-7-(o-chlorophenylamino)fluoran, 3-di(n-butyl)amino-7-(o-fluorophenylaminio)fluoran, 3l-(N-ethyl-N-isobutyl)amino-7(p-trifluoromethylanilino)fluoran, 3-diethylamino-7-(m-trifluoromethylanilino)fluoran, 3-(N-ethyl-N-isobutyl)amino-7-(o-trifluoromethylanilino)fluoran, 3-(N-methyl-N-cyclohexyl)amino-7-(o-trifluoromethylanilino)fluoran, 3-(N-ethyl-p-toluidino)-6-methyl-7-anilinofluoran, 3-(N-ethyl-N-furfurylamino)-6-methyl-7-anilinofluoran, 3-diethylamino-6-chloro-7-anilinofluoran, 3-(N-methyl-N-n-propylamino)-6-methyl-7-anilinofluoran, 3,3-bis[1(4-methoxyphenyl)-1-(4-dimethylaminophenylethylen-2-yl]-4,5,6,7-tetrachlorophthalide, 3l-p-(p-anilinoanilino)anilino-6-methyl-7-chlorofluoran, 2,2-bis{4-[6'-(N-cyclohexyl-N-methylamino)-3'-methylspiro(phthalide-3,9'-xanthen)-2'-ylamino]phenyl}propane, 3,6-bis(dimethylamino)fluorene-9-spiro-3'-(6'-dimethylamino)phthalide, 3-(N-ethyl-N-isobutyl)amino-7-(p-trifluoromethylanilino)fluoran, 3-(N-ethyl-N-isobutyl)amino-7-(o-trifluoromethylanilino) fluoran, 3-(N-ethyl-N-isoamyl)amino-7-(p-trifluoromethylanilino)fluoran, 3-di(n-butyl)amino-7-(m-trifluoromethylanilino)fluoran and the like. These dyes may be used in combination of at least two.

In general, the content of the above basic dye in the heat-sensitive recording layer is preferably 5 to 20 weight % based on the dry weight of the heat-sensitive recording layer.

As the developing agents used together with the basic dye, the following known compounds can be exemplified; phenolic compounds such as 4-tert-butylphenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol (Bisphenol A), hydroquinone, 4,4'-cyclohexylidenebisphenol, 4,4'-(1,3-dimethylbutylidene)bisphenol, 2,2-bis(4-hydroxyphenyl)-4-methylpentane, 4,4'-dihydroxydiphenylsulfide, 4,4'-dihydroxydiphenylsulfone, 2,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl) sulfone, 1,3-di[2-(4-hydroxyphenyl)-2-propyl]benzene, hydroquinone monobenzyl ether, phenyl 4-hydroxybenzoate, benzyl 4-hydroxybenzoate, tolyl 4-hydroxybenzoate, p-hydroxy-N-(2-phenoxyethyl)benzenesulfonamide, 1,8-bis(4-hydroxyphenylthio)-3,6-dioxaoctane, 2-(4-hydroxyphenylthio)ethyl (4-hydroxyphenylthio)acetate, Novolac phenol resins and phenol polymers.

When an aromatic compound having at least one group expressed by the formula: —$SO_2NHCX$—, where X is oxygen atom or sulfur atom, is used as the developing agent, a specific effect of the polyethylene emulsion is improved to remarably reduce head smudges. As the aromatic compound having the group expressed by the formula: —$SO_2NHCX$—, exemplified are those described in JP A 5-32061 and JP B 5-143753. Among them, 4,4'-bis(p-toluenesulfonylaminocarbonylamino)diphenylmethane and N-(p-toluenesulfonyl)-N'-phenylurea are high in the effect.

The used amount of the developing agent is preferably 50 to 500 weight % based on the colorless or light-colored basic dye.

In the heat-sensitive recording material according to the present invention, a sensitizer may be added to the recording layer. The sensitizers include, for example, stearamide, methoxycrbonyl-N-stearic benzamide, N-benzoylstearamide, N-eicosanamide, ethylenebis(stearamide), behenamide, methylenebis(stearamide), N-methylolstearamide, dibenzyl terephthalate, dimethyl terephthlate, dioctyl terephthalate, benzyl p-benzyloxybenzoate, phenyl 1-hydroxy-2-naphthoate, dibenzyl oxalate, di-p-methylbenzyl oxalate, di-p-chlorobenzyl oxalate, 2-naphthyl benzyl ether, m-terphenyl, p-benzylbiphenyl, tolyl biphenyl ether, di(p-methoxyphenoxyethyl)ether, 1,2-di(3-methylphenoxy)ethane, 1,2-di(4-methylphenoxy)ethane, 1,2-di(4-methoxyphenoxy) ethane, 1,2-di(4-chlorophenoxy)ethane, 1,2-diphenoxyethane, 1-(4-methoxyphenoxy)-2-(2-methylphenoxy) ethane, p-methylthiophenyl benzyl ether, 1,4-di(phenylthio)butane, p-acetotoluidide, p-acetophenetidide, N-acetoacetyl-p-toluidine, di-(β-biphenylethoxy)benzene, p-di-(vinyloxyethoxy)benzene and 1-isopropylphenyl-2-phenylethane.

The used amounts of these sensitizers are not particularly restricted but it is generally preferred to be controlled in the range lower than 400 weight % based on the developing agent.

In addition, so far as the effect of the present invention is not deteriorated, a shelf life improver can be also used in combination to further extend the shelf life of the recorded image according to the purpose. The shelf life improvers include, for example, hindered phenol compounds such as 2,2'-methylenebis(4-ethyl-6-tert-butylphenol), 2,2'-methylenebis(4,6-di-tert-butylphenol) 2,2'-ethylidenebis(4,6-di-tert-butylphenol), 2,2'-methylenebis(4-methoxy-6-tert-butylphenol), 2,2'-methylenebis(6-tert-butylphenol), 4,4'-thiobis(2-methyl-6-tert-butylphenol), 4,4'-thiobis(5-methyl-6-tert-butylphenol), 4,4'-thiobis(2-ethyl-6-tert-butylphenol), 4,4'-butylidenebis(6-tert-butyl-m-cresol), 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methylphenol), 2,2-bis(4-hydroxy-3,5-dibromophenyl) propane, 2,2-bis(4-hydroxy-3,5-dichlorophenyl)propane and 2,2-bis(4-hydroxy-3,5-dimethylphenyl)propane; epoxy compounds such as 1,4-diglycidyloxybenzene, 4,4'-diglycidyloxy-diphenylsulfone, diglycidyl terephthalate and Bisphenol A epoxy resin; 1-[α-methyl-α-(4'-hydroxyphenyl)ethyl]-4-[α',α'-bis(4"-hydroxyphenyl)ethyl]benzene, N,N'-di-2-naphthyl-p-phenylenediamine and sodium 2,2'-methylenebis(4,6-d-tert-butylphenyl)phosphate and the like.

A coating composition for the recording layer can be generally prepared by using water as the dispersing medium. For example, a basic dye, a developing agent and, if required, a sensitizer are simultaneously or separately dispersed in water with use of a mixer or pulverizer such as a ball mill, an attritor, a sand mill and the like to prepare the coating composition.

In such a coating composition, an adhesive may be added in an amount of 10 to 40 weight %, preferably 15 to 30 weight % based on the total solid content. The adhesives include such as starches, hydroxyethylcellulose, methylcellulose, carboxymethylcellulose, gelatin, casein, gum arabic, polyvinyl alcohol, diisobutylene-maleic anhydride copolymer salts, styrene-maleic anhydride copolymer salts, ethylene-acrylic acid copolymer salts, styrene-acrylic acid copolymer salts, styrene-butadiene copolymer emulsion and complex emulsions thereof with inorganic pigments.

Various auxiliaries can be added to the coating solution. For example, dispersants such as sodium dioctylsulfosuccinate, sodium dodecylbenzenesulfonate, sodium lauryl sulfate, alginates and metal salts of fatty acids; ultraviolet absorbers such as benzophenones and triazoles; antifoams; fluorescent dyes; coloring dyes and the like. Further, if required, lubricants such as zinc stearate and calcium stearate; and inorganic pigments such as kaolin, clay, talc, calcium carbonate, calcined clay, titanium oxide, diatomaceous earth, finely divided anhydrous silica, aluminum hydroxide and activated clay can be added to the coating solution.

By using particularly aluminum hydroxide having an average particle size of 3 to 15 μm as the inorganic pigment in an amount of 5 to 200 weight %, preferably 10 to 100 weight % based on the colorless or light-colored basic dye, deterioration of recorded images caused by sticking between the thermal head and the recording layer surface and smudge adhesion on the thermal head are prevented during recording. An amount lower than 5 weight % does not substantially improve anti-sticking, while an amount higher than 200 weight % may lower the recording density.

In the present invention, the method for the formation of the heat-sensitive recording layer is not particularly limited. For example, it can be formed by applying a coating composition on the support by a usual coating method such as air-knife coating, bariber-blade coating, pure-blade coating, rod-blade coating, short-dwell coating, curtain coating, dye coating and the like and then drying it. As the support, properly selected for use are paper, plastic films, synthetic papers, nonwoven fabrics, metal deposits. The amount of the coating composition applied to form the recording layer is controlled in the range of 2 to 12 $g/m^2$, preferably about 3 to 10 $g/m^2$, on dry basis.

Further, if required, a protective layer can be provided on the front and the back of the recording layer to more enhance the image-retainability of the heat-sensitive recording material. Furthermore, various known technologies in the field of manufacturing heat-sensitive recording materials such as providing an undercoat on the support, smoothening by super-calendering and the like after all layers have been applied, applying an adhesive on the back of the recording material to produce adhesive labels, and the like.

PREFERRED EMBODIMENTS OF THE INVENTION

The present invention will be illustrated in more details by Examples as follows. However, it is not limited to them. Unless otherwise specified, parts and % signify parts by weight and % by weight, respectively.

Example 1

(1) Preparation of Liquid A

The following composition was pulverized to an average particle size not larger than 1.5 microns in a sand mill.

| | |
|---|---|
| 3-di(n-butyl)amino-6-methyl-7-anilinofluoran | 10 parts |
| 5% aqueous solution of methylcellulose | 5 parts |
| water | 40 parts |

(2) Preparation of Liquid B

The following composition was pulverized to an average particle size not larger than 2 microns in a sand mill.

| | |
|---|---|
| 4-hydroxy-4'-isopropoxydiphenylsulfone | 20 parts |
| 5% aqueous solution of methylcellulose | 5 parts |
| water | 55 parts |

(3) Preparation of Liquid C

The following composition was pulverized to an average particle size not larger than 2 microns in a sand mill.

| | |
|---|---|
| 1,2-di(3-methylphenoxy)ethane | 20 parts |
| 5% aqueous solution of methylcellulose | 5 parts |
| water | 55 parts |

(4) Making a Heat-sensitive Recording Material

The following composition was mixed to prepare a coating composition.

| | |
|---|---|
| Liquid A | 55 parts |
| Liquid B | 80 parts |
| Liquid C | 230 parts |
| 10% aqueous solution or polyvinyl alcohol | 80 parts |
| precipitated calcium carbonate having an average particle size of 1 micron | 35 parts |
| polyethylene emulsion manufactured by Futaba Kagaku Co., without a surfactant trade name: CW-200-5 solid content: 40% melting point of the polyethylene: 80° C. | 20 parts |

The coating composition was applied on one side of a wood free paper of 60 g/m$^2$ in an amount of 6 g/m$^2$ on dry basis and died to form a recording layer. Then the product was super-calendered to obtain a heat-sensitive recording material.

Example 2

A heat-sensitive recording material was prepared in the same manner as in Example 1 except that a polyethylene emulsion manufactured by Futaba Kagaku Co. without a surfactant (trade name: CW-200-11, solid content: 40%, melting point of the polyethylene: 70° C.) was used instead of the polyethylene emulsion (trade name: CW-200-5).

Example 3

A heat-sensitive recording material was prepared in the same manner as in Example 1 except that 10 parts of 4-hydroxy-4'-isopropoxydiphenylsulfone and 10 parts of 4,4'-bis(p-toluenesulfonylaminocarbonylamino)diphenylmethane were used instead of 20 parts of 4-hydroxy-4'-isopropoxydiphenylsulfone to prepare Liquid B.

Example 4

A heat-sensitive recording material was prepared in the same manner as in Example 1 except that 10 parts of 4,4'-bis(p-toluene-sulfonylaminocarbonylamino)diphenylmethane and 10 parts of N-(p-toluene-sulfonyl)-N'-phenylurea were used instead of 20 parts of 4-hydroxy-4'-isopropoxydiphenylsulfone to prepare Liquid B.

Example 5

A heat-sensitive recording material was prepared in the same manner as in Example 3 except that 5 parts of aluminum hydroxide having an average particle size of 5 microns, 15 parts of amorphous silica and 15 parts of kaolin having an average particle size of 1 micron were used instead of 35 parts of precipitated calcium carbonate having an average particle size of 1 micron to prepare the recording layer.

Example 6

A heat-sensitive recording material was prepared in the same manner as in Example 3 except that 25 parts of aluminum hydroxide having an average particle size of 5 microns, 5 parts of amorphous silica and 5 parts of precipitated calcium carbonate having an average particle size of 1 micron were used instead of 35 parts of precipitated calcium carbonate having an average particle size of 1 micron to prepare the recording layer.

Example 7

A heat-sensitive recording material was prepared in the same manner as in Example 3 except that 2 parts of aluminum hydroxide having an average particle size of 8 microns, 15 parts of amorphous silica and 18 parts of kaolin having an average particle size of 1 micron were used instead of 35 parts of precipitated calcium carbonate having an average particle size of 1 micron to prepare the recording layer.

Comparative Example 1

A heat-sensitive recording material was prepared in the same manner as in Example 1 except that 27 parts of a paraffin wax emulsion manufactured by Chukyo Yushi Co. with use of an emulsifier (trade name: Hydrin P-7, solid content: 30%, melting point of the paraffin wax: 60° C.) was used instead of 20 parts of a polyethylene emulsion (trade name: CW-200-5) comprising no emulsifier.

Comparative Example 2

A heat-sensitive recording material was prepared in the same manner as in Example 1 except that 27 parts of a polyethylene emulsion manufactured with use of an anionic emulsifier and a nonionic emulsufier (solid content: 30%, melting point of the polyethylene: 5° C.) was used instead of 20 parts of a polyethylene emulsion (trade name: CW-200-5) comprising no emulsifier.

The following quality evaluation tests were carried out on the heat-sensitive recording materials thus prepared and the results are shown in Table 1.

(Evaluation)

(1) Color Density

The color density of the recorded image obtained by printing with a heat-sensitive record tester (Type TH-PMD, manufactured by Okura Denki Co., applied energy: 0.4 mJ/dot) was measured by a Macbeth densitometer (manufactured by Macbeth Corp., Type RD-914R) in visual mode.

(2) Oil Resistance

The heat-resistance recording material after recorded by the above method (1) was immersed in salad oil and stood at room temperature for 3 hours and then the density of the residual image was measured by a Macbeth densitometer (visual mode) to evaluate the oil resistance.

(3) Smudge Adhesion on Head 30 meters of the heat-sensitive recording materials were printed by a heat-sensitive record tester (Type TH-PMD, manufactured by Ookura Denki Co., applied energy: 0.4 mJ/dot) and then the amount of smudge adhesion on head was judged macroscopically.

Criteria

⊙: Absolutely no smudge.

○: Substantially no smudge.

Δ: Slightly adhered smudge.

x: Much smudges.

(4) Water Resistance

A water drop was dropped on the surface of the recording material and the surface rubbed by a finger 10 times and the peeled extent of the recording layer was judged macroscopically.

Criteria

○: Absolutely no peeling on the surface.

x: The surface was peeled off.

(5) Anti-sticking

When printed by a heat-sensitive record tester (Type TH-PMD, manufactured by Ookura Denki Co., applied energy: 0.4 mJ/dot, pulse duration: 3 ms), the sticking generated on the recorded image was judged macroscopically.

Criteria

⊙: Substantially no sticking.

○: Some sticking.

x: Much sticking

TABLE 1

| | Recorded density | Oil resistance | Smudge on head | Water resistance | Anti-sticking |
|---|---|---|---|---|---|
| Example 1 | 1.32 | 0.72 | Δ | ○ | ○ |
| Example 2 | 1.35 | 0.70 | Δ | ○ | ○ |
| Example 3 | 1.36 | 0.92 | ○ | ○ | ○ |
| Example 4 | 1.33 | 1.18 | ○ | ○ | ○ |
| Example 5 | 1.36 | 0.97 | ○ | ○ | ⊙ |
| Example 6 | 1.24 | 0.90 | ⊙ | ○ | ⊙ |
| Example 7 | 1.31 | 0.95 | ○ | ○ | ⊙ |
| Comp. Ex. 1 | 1.35 | 0.45 | X | X | X |
| Comp. Ex. 2 | 1.40 | 0.57 | X | X | X |

As apparent from the results of Table 1, all of the heat-sensitive recording materials according to the present invention were excellent in image-retainability and water resistance and low in smudge adhesion on head.

What is claimed is:

1. A heat sensitive recording material which comprises a recording layer containing a colorless or light-colored basic dye and a developing agent on a support, the recording layer containing a polyethylene having a melting point not lower than 60° C. and aluminum hydroxide, the polyethylene being obtained as a emulsion not comprising a surfactant.

2. A heat-sensitive recording material according to claim 1, in which the developing agent is an aromatic compound having at least one specific functional group expressed by the formula —$SO_2NHCX$—, where X is oxygen or sulfur atom.

3. A heat sensitive recording material according to claim 1 or 2 in which the aluminum hydroxide has an average particle size of 3 to 15 μm and is comprised in an amount of 5 to 200 weight % based on the basic dye.

4. A method for preparing a heat-sensitive recording material, which comprises coating on a support an aqueous coating imposition containing a colorless or light-colored basic dye and a developing agent to form a recording layer, the coating composition further containing a polyethylene emulsion and aluminum hydroxide, the polyethylene emulsion containing a polyethylene having a melting point not lower than 60° C. but no surfactant.

5. A method according to claim 4, in which the developing agent is an aromatic component having at least one specific functional group expressed by the formula —$SO_2NHCX$—, where X is oxygen atom or sulfur atom.

6. A method according to claim 4 or 5, in which the aluminum hydroxide has an average particle size of 3 to 15 μm and is used in an amount of 3 to 200 eight % based on the basic dye.

* * * * *